United States Patent [19]
Russell
[11] 4,318,322
[45] Mar. 9, 1982

[54] ENVELOPE CUTTER APPARATUS

[75] Inventor: Robert J. Russell, Medford, N.J.
[73] Assignee: Mail-Ex Corporation, Skokie, Ill.

[21] Appl. No.: 78,921
[22] Filed: Sep. 26, 1979

Related U.S. Application Data

[60] Continuation-in-part of Ser. No. 962,399, Nov. 20, 1978, abandoned, which is a division of Ser. No. 801,454, May 31, 1977, Pat. No. 4,159,611, which is a continuation-in-part of Ser. No. 707,723, Jul. 22, 1976, abandoned.

[51] Int. Cl.[3] ..... B26D 1/24; B26D 7/06; B65B 43/18
[52] U.S. Cl. ..... 83/94; 83/912; 83/435.2; 83/417; 83/23; 83/438; 83/732; 83/100; 271/207; 271/223
[58] Field of Search ..... 83/94, 106, 912, 23, 83/417, 435.2, 438, 732; 271/207, 223

[56] References Cited

U.S. PATENT DOCUMENTS

| | | | |
|---|---|---|---|
| 3,046,010 | 7/1962 | Schneider | 271/223 |
| 3,154,356 | 10/1964 | Lewis et al. | 271/207 |
| 3,381,564 | 5/1968 | Whiteford | 83/912 |
| 3,545,136 | 12/1970 | Simjian | 83/912 X |
| 3,943,807 | 3/1976 | Bingham et al. | 83/912 X |
| 4,142,430 | 3/1979 | Long et al. | 83/912 X |
| 4,144,786 | 3/1979 | Beard et al. | 83/912 X |

*Primary Examiner*—Donald R. Schran
*Attorney, Agent, or Firm*—Trexler, Bushnell & Wolters, Ltd.

[57] ABSTRACT

There is disclosed an envelope processing machine in the form of an improved envelope cutter apparatus adapted to sever one edge of envelopes in one by one relationship. The apparatus includes a supply hopper for retaining the envelopes to be processed, cutting means for severing one edge of the envelopes, means for removing envelopes in one by one relationship from the supply hopper and for transmitting the removed envelopes to the cutting means, and means for orienting the envelopes in respect to the cutting means. The orienting means includes a plurality of angularly disposed feed belts operable upon the envelope and an abutment member against which an envelope is engaged in its movement to the cutting means. In a preferred form of the invention, the orienting means includes first belt means for causing the envelopes to engage the abutment member in advance of the cutting means and second belt means for retaining the envelopes against the abutment member and as the envelopes are severed by the cutting means.

17 Claims, 4 Drawing Figures

ENVELOPE CUTTER APPARATUS

RELATED APPLICATIONS

This application is a continuation-in-part of prior application Ser. No. 962,399, filed Nov. 20, 1978, now abandoned, which was a division of prior application Ser. No. 801,454, filed May 31, 1977, which issued on July 3, 1979 as U.S. Pat. No. 4,159,611 and which was a continuation-in-part of prior application Ser. No. 707,723 filed July 22, 1976, now abandoned.

BACKGROUND OF THE INVENTION

There are many business environments where great numbers of mailing pieces must be processed daily by opening the incoming mail envelopes and removing their contents. Literally thousands of mailing pieces are processed in this manner each day by banks, credit card companies, and utility companies to name just a few.

Both automatic and semi-automatic machines are known which facilitate the processing of incoming mail pieces as referred to above. The automatic machines remove the contents from the envelopes unattended by an operator while the semi-automatic machines present the envelopes to an operator in an opened condition for manual extraction of the contents. Both types of machines find considerable use, the semi-automatic machines being advantageous where lesser but still significant volumes of mail pieces must be processed. One such semi-automatic machine is fully shown and described in the aforementioned U.S. Pat. No. 4,159,611.

Although the machines shown and described in U.S. Pat. No. 4,159,611 includes an envelope cutter for severing one edge of an envelope, many machines do not include such an envelope cutter. Envelope cutters are necessary for severing at least one edge of the envelopes to be processed to allow the contents to be efficiently removed. Hence, many machines are adapted to act upon pre-cut envelopes only, and, as a result, separate envelope cutters are needed in the art.

Envelope cutters for use in conjunction with high volume mail processing machines must be of high-speed and capable of unattended operation. Such cutters must sever an edge portion from the envelopes with the edge portions being of sufficient width dimension to assure complete severance, but of narrow enough width to preclude the contents from being cut. Hence, registration of the envelopes with respect to the machine cutter blade is critical. However, registration of the envelopes with respect to the machine cutter blade has been difficult to obtain especially when the machines are operated at high speeds. Proper registration is rendered even still more difficult when envelopes of various dimensions are to be accommodated.

It is therefore a general object of the present invention to provide a new and improved cutter apparatus for severing one edge of an envelope.

It is a more particular object of the present invention to provide an improved envelope cutter apparatus which severs one edge of successive envelopes at high speed and which provides positive registration of the envelopes with respect to the cutting blade.

It is a still further object of the present invention to provide an improved envelope cutting apparatus which provides positive registration of the envelopes with respect to the cutting blade while operating at high-speed and which is capable of accommodating envelopes of various dimensions.

SUMMARY OF THE INVENTION

The present invention provides an envelope processing machine comprising a supply hopper for envelopes, cutting means for severing one edge of an envelope, means for removing envelopes in one by one relation from the supply hopper and for transmitting the removed envelopes to the cutting means, and means for orienting the envelopes with respect to the cutting means. The orienting means includes a plurality of angularly disposed feed belts operable upon the envelopes and an abutment member against which an envelope is engaged in its movement to the cutting means.

BRIEF DESCRIPTION OF THE DRAWINGS

The features of the present invention which are believed to be novel are set forth with particularity in the appended claims. The invention, together with further objects and advantages thereof, may best be understood by making reference to the following description taken in conjunction with the accompanying drawings, in the several figures of which like reference numerals identify identical elements, and wherein:

DESCRIPTION OF THE PREFERRED EMBODIMENT

Figure 1:
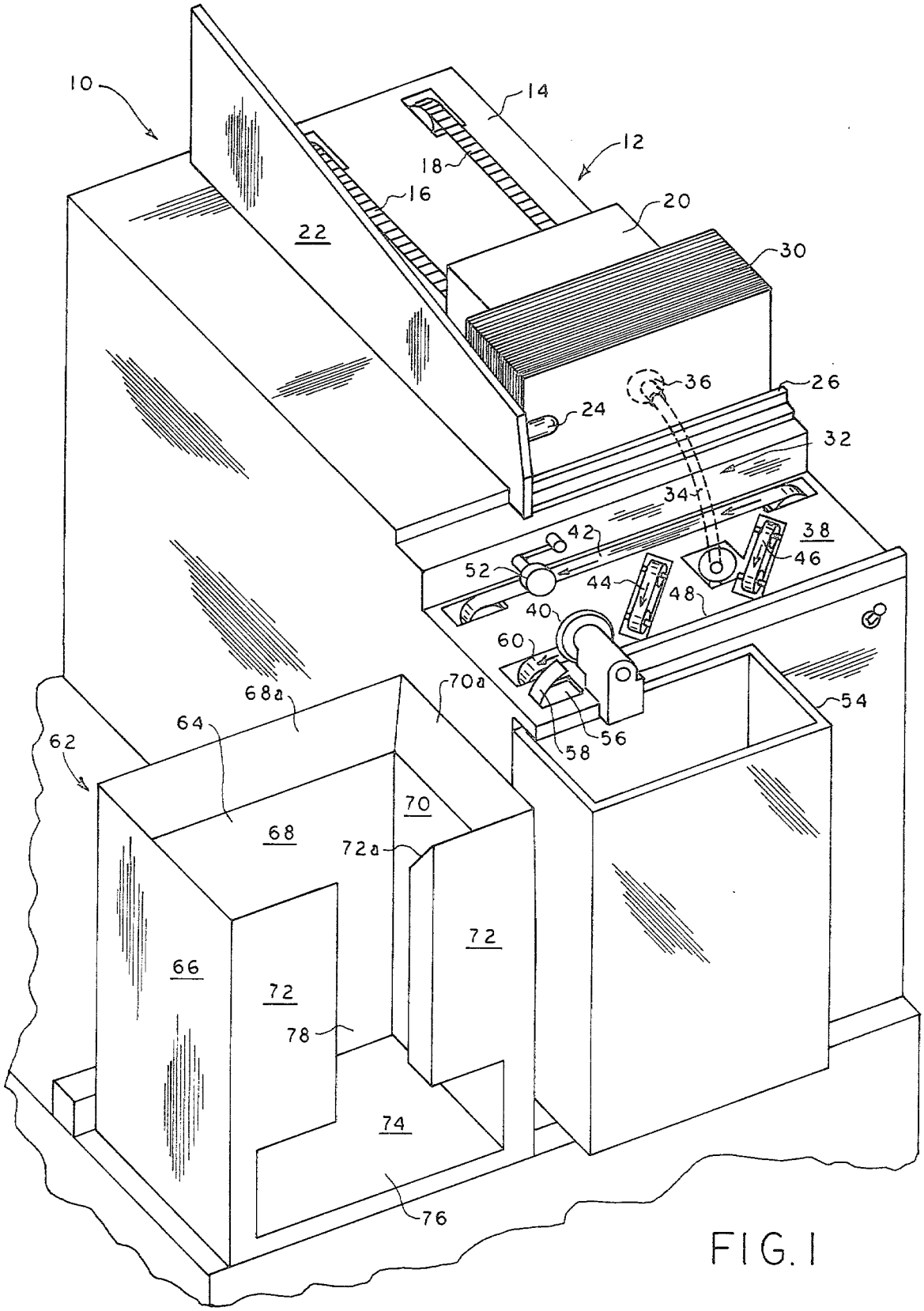
FIG. 1 is a perspective view illustrating an envelope cutting apparatus embodying the present invention.
Figure 2:
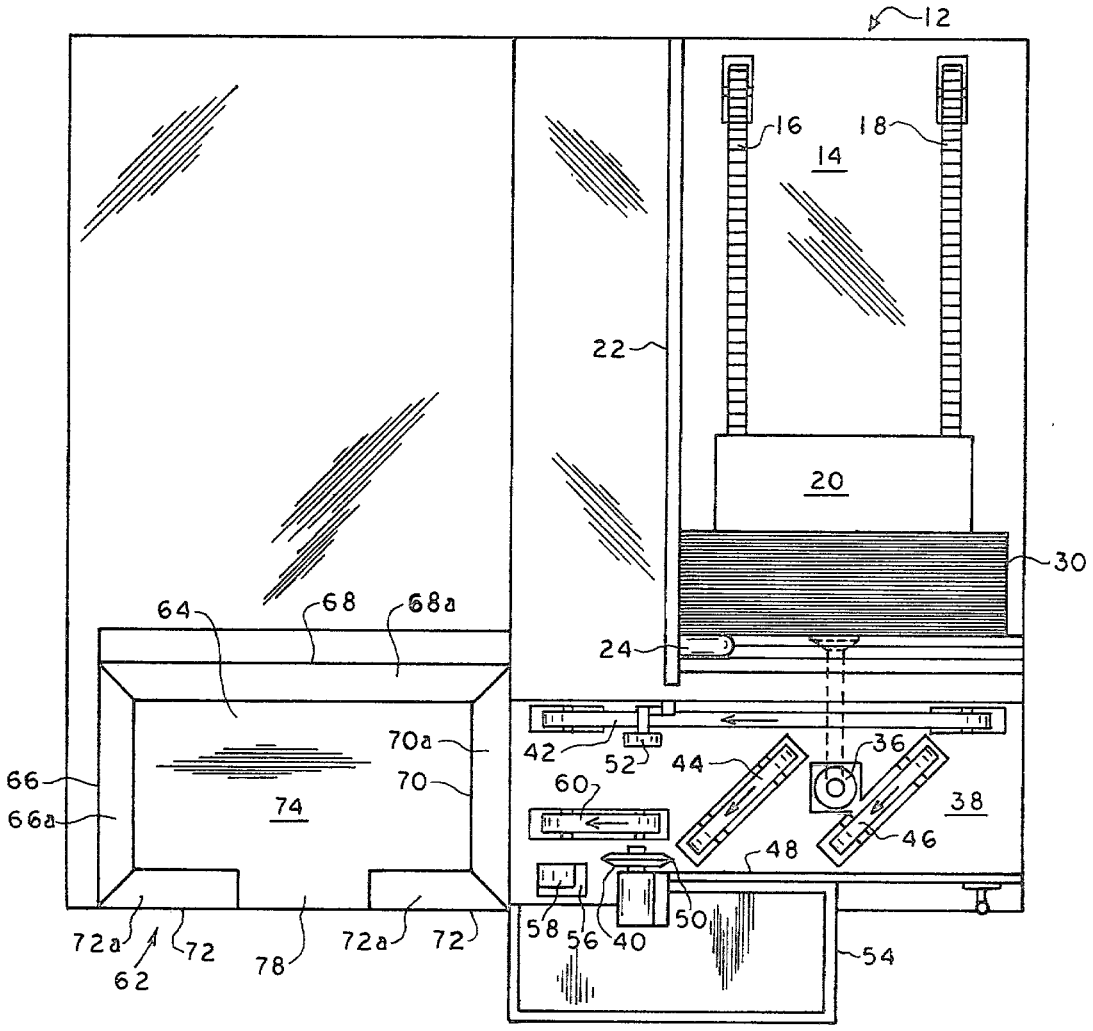
FIG. 2 is a top plan view of the apparatus of FIG. 1.
Figure 3:
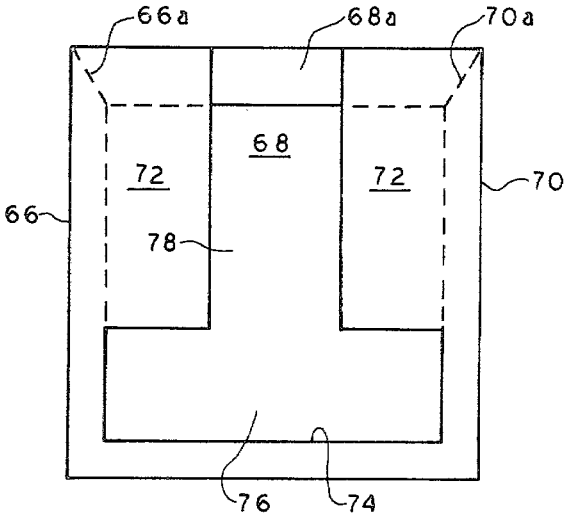
FIG. 3 is a side view of an envelope container adapted to receive and stack the severed envelopes in accordance with the present invention.

Referring now to FIGS. 1 and 2, the envelope cutter apparatus 10 there illustrated which embodys the present invention includes a hopper 12 for containing a supply of envelopes 30 to be processed in a ready condition. The hopper 12 includes a ramp surface 14, a pair of conveyor belts 16 and 18, a weight block 20, a partition wall 22, a projection 24, and a vertical rib 26. The envelopes 30 to be processed are substantially vertically disposed with one side edge of the envelopes being closely adjacent to the partition wall 22. The projection 24 projects towards the envelopes from the partition wall 22 and the rib 26 extends vertically from the ramp surface 14 so as to confine the envelopes 30 in their substantially vertical position. During the operation of the cutter apparatus, the envelopes 30 are removed from the hopper in a one by one relationship. As the envelopes are removed, the belts 16 and 18 are driven to advance the envelopes towards the forward portion of the supply hopper so that the most forward envelope is in engagement with the projection 24 and the rib 26. The weight block 20 serves to retain the envelopes in their stacked relation and to further promote the advancement of the envelopes toward the forward portion of the supply hopper.

The envelopes 30 are removed from the supply hopper by a removing means 32 which includes a reciprocating arm 34 having a suction cup 36 at one end thereof. The arm 34 is arranged for reciprocal movement from a retracted position as shown in solid line to a fully extended position as indicated by the dashed lines. When fully extended, the suction cup 36 at the end of arm 34 engages the most forward envelope. Negative air pressure is applied to the arm 34 which is then transmitted to the suction cup 36 to create the air suction thereat to cause the suction cup 36 to engage and grip the most forward envelope. The arm 34 is then retracted toward a horizontal top plate 38. An appropriate mechanism for operating the reciprocating arm 34 is fully shown and described in the aforementioned U.S. Pat. No. 4,159,611 which is incorporated herein by reference.

The machine 10 also includes a cutting means for severing one edge of the envelope 30 which takes the form of a substantially vertically disposed rotary cutting blade 40. The envelopes are transmitted to the cutting blade 40 in a substantially horizontal disposition by transmitting means which include a conveyor belt 42 and an envelope orienting means comprising a pair of substantially parallel conveyor belts 44 and 46 and an abutment wall 48. As can be best noted in FIG. 2, the rotary blade 40 has a cutting edge 50 which is spaced from the abutment wall 48. As will become clear subsequently, this spacing between the cutting edge 50 and the abutment wall 48 defines the width of the edge portion which is severed from the envelope by the cutting blade 40.

As the arm 34 returns to its retracted position, it places the envelopes onto the conveyor belts 42, 44, and 46 with its top edge (with reference to its stacked position) spaced from the abutment wall 48. The conveyor belt 42 which extends substantially parallel to the abutment wall 48 serves to move the envelope laterally towards the rotary blade 40 while the belts 44 and 46 move the envelope diagonally into engagement with the abutment wall 48. The belts 44 and 46 are arranged to form an included angle with the abutment wall 48 such that the top marginal edge of the envelopes will engage the abutment wall 48 in advance of the cutting blade 40.

As the envelope engages the cutting blade 40, it also engages a pressure roller 52. Roller 52 along with the belts 44 and 46 serves to hold the envelope in continuous engagement with the abutment wall 48 as its top edge portion is severed.

The machine 10 also includes a collecting box 54 disposed partially beneath the horizontal top plate 38 for collecting the scrap severed edge portions of the envelopes. A rectangular opening 56 within the top plate 38 allows the scrap severed edge portions to drop into the collecting box 54. A deflector 58 which extends from the top plate 38 and over the opening 56 directs the scrap envelope edge portions into the opening 56.

After the envelopes are cut by the cutting blade 40, the conveyor belt 42 and another belt 60, also substantially parallel to the abutment wall 48, transfer the envelopes to a receiving station 62 which includes a container 64. The container 64 has a plurality of sidewalls 66, 68, 70, and 72 having tapered upper edge portions **66*a*, 68*a*, 70*a*, and 72*a* respectively. The sidewalls of the container 64 are dimensioned for confining the envelopes therein and retaining the envelopes in a stacked relation from its bottom 74. The container includes an elongate substantially horizontal opening 76 within the sidewall 72 to afford removal of a quantity of the stacked truck envelopes. A further elongate vertical opening 78 also within sidewall 72 and communicating with the opening 76 is provided to afford ready removal of all of the stacked envelopes within the container if such is desired. Hence, after the envelopes are cut by the cutting blade 40, the conveyor belts 42 and 60 transfer the envelopes from the cutter and allow the envelopes to drop into the container 64** which disposes the envelopes in a vertical relation for ready removal and further processing.

As can be noted from the foregoing, the belts 44 and 46 and the abutment wall 48 cooperate to orientate the envelopes with respect to the cutting blade in advance of the cutting blade. Because the envelopes are positively driven by the conveyor belts 44 and 46 against the vertical abutment wall 48, the envelopes are positively aligned with respect to the cutting blade to assure accurate registration of the envelopes notwithstanding high-speed operation of the machine. Furthermore, because the envelopes are placed onto the conveyor belts 44 and 46 with their top edges displaced from the vertical abutment wall 48, the machine of the present invention is adapted to act upon envelopes of various sizes without requiring any adjustment of the machine whatsoever.

Figure 4:
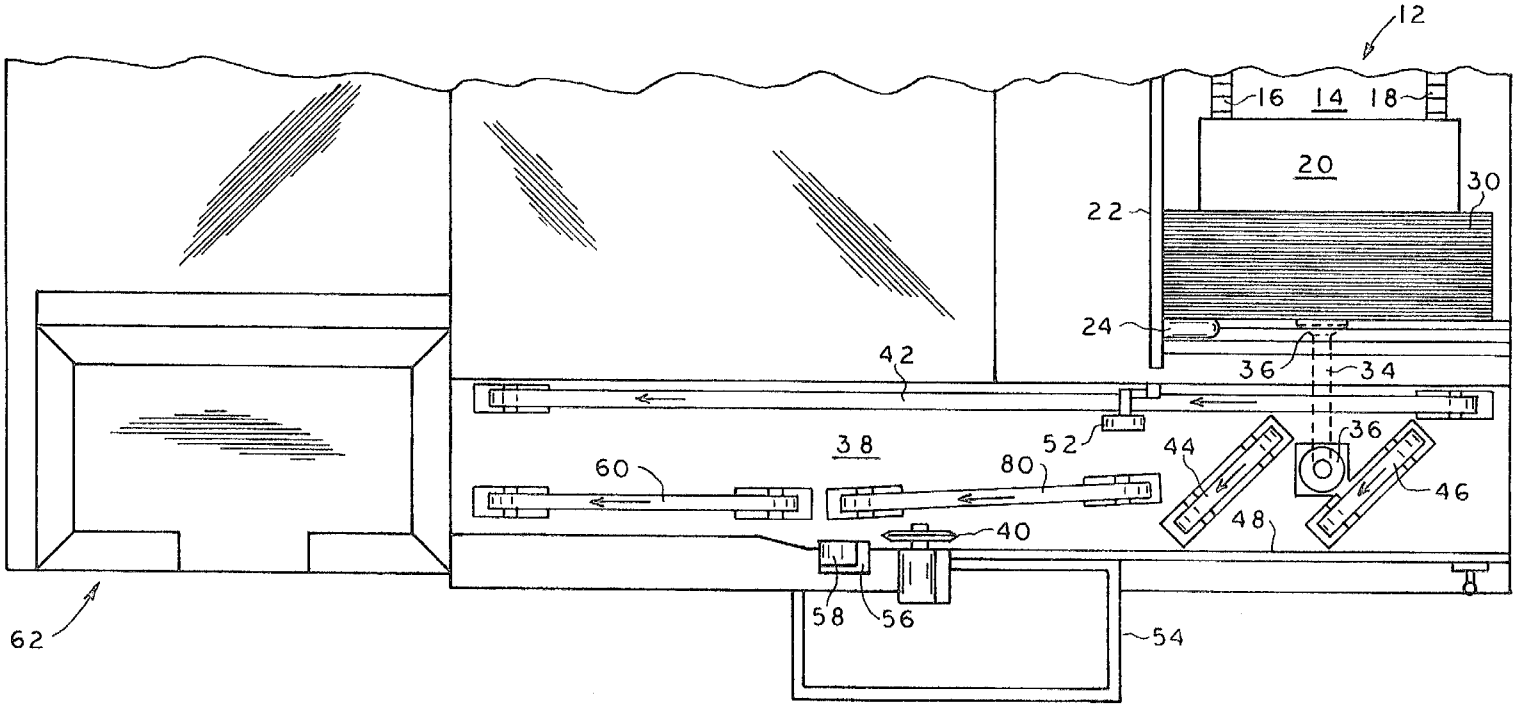
FIG. 4 is a partial top plan view of another envelope cutter apparatus embodying the present invention.

Referring now to FIG. 4, the apparatus there illustrated is essentially identical to the apparatus illustrated in FIGS. 1 and 2 except that an additional belt 80 has been added and the horizontal top plate 38 is longer in lateral dimension than the horizontal top plate 38 of FIG. 1. The added belt 80 like belts 44 and 46 is also angularly disposed with respect to the vertical abutment wall 48. However, the included angle between the belts 44, 46 and the abutment wall 48 is greater than the included angle between the belt 80 and the abutment wall 48.

The belt 80 serves to hold the envelopes against the abutment wall 48 as they are cut by the cutting blade 40. The belts 44 and 46, as previously described, serve to move the envelopes diagonally into engagement with the abutment wall 48. Hence, the machine of FIG. 4 includes an orienting means for the envelopes which includes a first belt means comprising belts 44 and 46 which move the envelopes into engagement with the abutment wall 48, and a second belt means comprising belt 80 which retains the envelopes against the abutment wall as the envelopes are severed by the cutting means.

Like the machine of FIGS. 1 and 2, the apparatus of FIG. 4 is adapted to accommodate envelopes of various dimensions. As the envelopes 30 are placed onto the belts 44 and 46 by the reciprocating arm 34, the top edges of the envelopes will be initially spaced from the abutment wall 48. Hence, envelopes of various dimensions may be cut by the apparatus of FIG. 4 with the initial spacing between the top edge of the envelopes and the abutment wall 48 being determined by the dimension of the envelopes. Larger envelopes will have a smaller initial spacing from the abutment wall 48 than smaller envelopes. However, due to the rather large included angle between the belts 44 and 46 with respect to the abutment wall 48, the envelopes placed onto these belts will be rapidly brought into engagement with the abutment wall 48 for registration with the cutting blade 40. As a result, envelopes of various dimensions may be accommodated by the apparatus of FIG. 4 without requiring adjustment of the apparatus.

In all other respects, the operation of the apparatus of FIG. 4 is identical to the operation of the apparatus of FIGS. 1 and 2. The belt 42 has been extended for coacting with belt 60 to deliver the severed envelopes to the receiving station 62.

While particular embodiments of the present invention have been shown and described, modifications may be made, and it is therefore intended to cover in the appended claims all such changes and modifications which fall within the true spirit and scope of the invention.

The invention is claimed as follows:

1. An envelope processing machine comprising: a supply hopper for envelopes; cutting means for severing one edge of an envelope; a receiving station for the severed envelopes; means for removing envelopes in one by one relationship from the supply hopper; conveying means for receiving the envelopes removed from the supply hopper and transmitting the removed envelopes in predetermined feeding direction through the cutting means to the receiving station; an abutment member spaced laterally from the conveying means and against which an envelope is to be engaged in its movement to the cutting means; and means for orienting the envelopes in respect to the cutting means, said orienting means including a plurality of feed belts located in the space between the conveying means and the abutment member and angularly disposed relative to the feeding direction of the conveying means and inclined in the direction of the cutting means and operable upon the envelopes for permissive shifting of the same laterally in the plane of the conveying means into engagement with the abutment member for the cutting operation.

2. A machine as defined in claim 1 wherein said conveying means comprises a plurality of conveyor belts extending from said cutting means to said receiving station substantially parallel to said abutment member.

3. A machine as defined in claim 1 wherein said receiving station comprises container means having plural sidewalls and dimensioned for confining and aligning the severed envelopes in stacked relation.

4. A machine as defined in claim 3 wherein one of said sidewalls includes an elongated opening through which a quantity of the stacked severed envelopes may be removed.

5. A machine as defined in claim 4 wherein said opening is adjacent to the bottom of said container means.

6. A machine as defined in claim 1 wherein said feed belts are of progressively different angularity in respect to the abutment member against which an envelope is engaged by movement of the belts.

7. A machine as defined in claim 1 wherein said orienting means comprises first belt means for causing the envelopes to engage said abutment member in advance of said cutting means and second belt means for retaining the envelopes against said abutment member as the envelopes are severed by said cutting means.

8. A machine as defined in claim 7 wherein the included angle between said first belt means and said abutment member is greater than the included angle between said second belt means and said abutment member.

9. A machine as defined in claim 8 wherein said first belt means comprises a pair of belts arranged in substantially parallel relation at an abrupt angle less than 90 degrees to said conveying means in the direction of the cutting means for rapid traverse of the envelopes to the abutment member.

10. A machine as defined in claim 1 wherein said conveying means and feed belts are arranged to move the envelopes in a substantially horizontal coplanar disposition, wherein said abutment member comprises a substantially vertical wall for engaging one edge of the envelopes, and wherein said cutting means comprises a substantially vertically disposed rotary blade having a cutting edge spaced from said abutment wall for severing an edge portion from the envelopes having a width dimension determined by the spacing of said rotary blade from said abutment wall.

11. A machine as defined in claim 10 further including collecting means beneath said rotary blade for collecting said severed envelope edge portions and diverting means for directing said severed edge portions into said collecting means.

12. A machine as defined in claim 10 wherein said envelope removing means comprises a reciprocating arm having a suction cup at one end thereof and arranged for engaging the envelopes at said hopper and placing the envelopes onto said feed belts.

13. A machine as defined in claim 1 wherein the conveying means extends in spaced parallel relationship to the abutment member with the feed belts angled therebetween in inclined directions of the cutting means and the abutment member.

14. A machine as defined in claim 13 wherein the feed belts are parallel and angled at an abrupt angle less than 90 degrees for close coupled rapid traverse of the envelopes to the abutment member for the cutting operation.

15. A machine as defined in claim 14 wherein an additional conveyor is provided in spaced relation to the conveying means and adjacent the cutting means to assist in transmitting the severed envelopes from the cutting means to the receiving station.

16. A machine as defined in claim 14 wherein the feed belts are positioned proximate to the supply hopper for receiving envelopes removed therefrom substantially in unison with deposit thereof on the conveying means.

17. A machine as defined in claim 16 wherein an additional conveyor is provided between the feed belts and the cutting means and at a lesser angle than said feed belts to assist in maintaining the envelopes in position for the cutting operation.

* * * * *